US008371229B1

(12) United States Patent
Sailor

(10) Patent No.: US 8,371,229 B1
(45) Date of Patent: Feb. 12, 2013

(54) TRACK CLEANING CAR

(76) Inventor: Michael A. Sailor, Canyon Country, CA (US)

( * ) Notice: Subject to any disclaimer, the term of this patent is extended or adjusted under 35 U.S.C. 154(b) by 0 days.

(21) Appl. No.: 13/306,748

(22) Filed: Nov. 29, 2011

Related U.S. Application Data

(60) Provisional application No. 61/506,711, filed on Jul. 12, 2011.

(51) Int. Cl.
*B61F 19/00* (2006.01)

(52) U.S. Cl. ..... 104/279; 105/1.5

(58) Field of Classification Search ..... 104/279; 105/1.5, 394; 15/49.1, 54, 78, 82, 87
See application file for complete search history.

(56) References Cited

U.S. PATENT DOCUMENTS

| | | | | | |
|---|---|---|---|---|---|
| 815,308 | A | * | 3/1906 | Perry | 15/55 |
| 1,255,519 | A | * | 2/1918 | Ellis | 15/84 |
| 1,409,011 | A | * | 3/1922 | Kelly et al. | 104/279 |
| 1,469,464 | A | * | 10/1923 | Ursino | 37/104 |
| 2,475,771 | A | * | 7/1949 | Wittner | 104/279 |
| 2,727,263 | A | * | 12/1955 | Dangremond et al. | 15/55 |
| 2,748,720 | A | * | 6/1956 | Kling | 104/279 |
| 3,004,273 | A | * | 10/1961 | Rushmer | 15/55 |
| 3,005,274 | A | * | 10/1961 | Kershaw | 37/104 |
| 3,137,018 | A | * | 6/1964 | Seffker | 15/55 |
| 3,533,121 | A | * | 10/1970 | Kershaw | 15/55 |
| 4,393,537 | A | * | 7/1983 | Reprogle et al. | 15/348 |
| 4,480,350 | A | * | 11/1984 | White | 15/207.2 |
| 4,741,072 | A | * | 5/1988 | Wilkerson | 15/312.1 |
| 4,811,447 | A | * | 3/1989 | Everson | 15/207.2 |
| 5,060,335 | A | * | 10/1991 | Webster | 15/97.1 |
| 5,249,332 | A | * | 10/1993 | Wilkerson | 15/384 |
| 5,437,233 | A | * | 8/1995 | Richter | 104/279 |
| 5,493,795 | A | * | 2/1996 | Bail | 37/104 |
| 5,579,553 | A | * | 12/1996 | Holley | 15/55 |
| 5,673,626 | A | * | 10/1997 | Jaeggi | 104/279 |
| 5,695,574 | A | * | 12/1997 | Falardeau et al. | 134/6 |
| 5,816,168 | A | * | 10/1998 | Poissant | 104/279 |
| 6,154,920 | A | * | 12/2000 | Petrole et al. | 15/349 |
| 6,536,355 | B1 | | 3/2003 | Amemiya | |
| 6,565,410 | B1 | * | 5/2003 | Allen | 446/454 |
| 6,758,145 | B1 | * | 7/2004 | Hefter | 104/279 |
| 2006/0196386 | A1 | * | 9/2006 | Mull | 104/279 |
| 2007/0039514 | A1 | * | 2/2007 | Godard et al. | 104/279 |
| 2008/0216702 | A1 | * | 9/2008 | Leonowicz | 104/279 |
| 2010/0258026 | A1 | * | 10/2010 | Kanemori et al. | 104/279 |

FOREIGN PATENT DOCUMENTS

JP 10203360 A * 8/1998

* cited by examiner

*Primary Examiner* — Jason C Smith

(57) ABSTRACT

A track cleaning car that includes a base plate having a top surface, a bottom surface, a front end, and a rear end, a hole centrally disposed in the base plate with a motor suspended over the hole, the motor disposed from a floating plate compressibly mounted over the base plate on a plurality of springs, each of the plurality of springs disposed around each of a plurality of guide rods, the motor engaging a driveshaft to rotate a rotatable disk with a cleaning pad removably attachable thereto, and the track cleaning car having a photomicroprocessor sensible of the motion of the track cleaning car, the photomicroprocessor arresting the motor when sensing the track cleaning car is at rest.

18 Claims, 5 Drawing Sheets

TRACK CLEANING CAR

CROSS-REFERENCE TO RELATED APPLICATIONS

U.S. Provisional Application No. 61/506,711 Filed Jul. 12, 2011

FEDERALLY SPONSORED RESEARCH OR DEVELOPMENT

Not Applicable

INCORPORATION BY REFERENCE OF MATERIAL SUBMITTED ON A COMPACT DISK

Not Applicable

TO ALL WHOM IT MAY CONCERN

Be it known that I, Michael A. Sailor, a citizen of the United States, have invented new and useful improvements in a track cleaning car as described in this specification. I claim benefit of my U.S. Provisional Application No. 61/506,711 filed on Jul. 12, 2011.

BACKGROUND OF THE INVENTION

Various types of track cleaning cars are known in the prior art. However, what is needed is a track cleaning car that includes a floating plate compressibly engaging a cleaning pad with an extant rail track, the cleaning pad releasably attachable to a rotating disk disposed on a lower end of a driveshaft powered by a motor, said motor in operational communication with a control panel and a photomicroprocessor, which photomicroprocessor interrupts the motor when the track cleaning car is not in motion.

FIELD OF THE INVENTION

The present invention relates to a track cleaning car, and more particularly, to a track cleaning car that a floating plate compressibly engaging a cleaning pad with an extant rail track, the cleaning pad releasably attachable to a rotating disk disposed on a lower end of a driveshaft powered by a motor, said motor in operational communication with a control panel and a photomicroprocessor, which photomicroprocessor interrupts the motor when the track cleaning car is not in motion.

SUMMARY OF THE INVENTION

The general purpose of the present track cleaning car, described subsequently in greater detail, is to provide a track cleaning car which has many novel features that result in a track cleaning car which is not anticipated, rendered obvious, suggested, or even implied by prior art, either alone or in combination thereof.

As an avid railroad gardener, I have enjoyed using a model railroad in the landscaping at my home. The greatest problem I have encountered is a dirty track. In order for a locomotive to run smoothly over track placed in landscaping, the track must be clean. Many times I've had to resort to cleaning the track by hand with chemical cleaners and a cleaning pad. The chemicals are often deleterious to plants alongside the track, and cleaning by hand is laborious and time consuming.

Cleaning sections of track through tunnels and over bridges by hand is particularly difficult, and potentially dangerous.

Having conducted a thorough comparison of available track cleaning cars, I noted several problems I sought to address in the present invention. Most track cleaning cars evinced in the prior art have a cleaning apparatus independent of the motion of the cleaning car itself. In other words, when such cleaning cars come to a stop, the cleaning apparatus continues to operate, rendering increased wear and damage to the track section atop which the cleaning car has come to rest.

The present invention, therefore, addresses this problem while combining additional features and elements to provide a useful improvement to the art. The present track cleaning car includes a parallelepiped base plate having a top surface, a bottom surface, a front end, and a rear end. A hole is centrally disposed in the base plate, and a motor is suspended through the hole depending from a floating plate disposed above the base plate in a plane parallel with the top surface. The floating plate is compressibly mounted above the base plate by means of a plurality of guide rods, each of the plurality of guide rods vertically disposed through each of a plurality of guide holes disposed in the base plate. Each of a plurality of springs is disposed around each of the plurality of guide rods between the floating plate and the base plate, each of the plurality of springs compressibly engaging the floating plate above the base plate.

A rotatable driveshaft is engageable by the motor, the driveshaft projected through the hole. A rotatable disk is disposed at a lower end of the driveshaft, the rotatable disk disposed in a plane parallel with the bottom surface of the base plate. A cleaning pad is releasably attachable to a lower surface of the rotatable disk.

The motor is in operational communication with a control panel and a battery mounted on the base plate top surface. The motor is alternately powered by an extant powered rail track, if the present track cleaning car is operated on a powered track. When the motor is activated, the cleaning pad is rotated by means of the driveshaft engaging the rotatable disk. The floating plate thusly compressibly engages the cleaning pad upon an extant track, the springs limiting the pressure of the cleaning pad upon the track while allowing upward movement of the cleaning pad. Further, the cleaning pad is removably fastenable to the rotatable disk, enabling replacement and use of different gauge cleaning pads, as desirable when cleaning tracks under a variety of conditions requiring cleaning and polishing.

A first wheel assembly is disposed on the base plate bottom surface proximal to the front end. The first wheel assembly includes a first axle and a second axel rotatably disposed in parallel within a forward truck. A first pair of wheels is disposed endwise on the first axle, and a second pair of wheels is disposed on the second axle. A counter wheel is disposed on the second axle, the counter wheel disposed parallel the second pair of wheels. When the second pair of wheels rotate, the counter wheel rotates synchronously.

A photomicroprocessor is in operational communication with the battery, the counter wheel, and the motor. The photomicroprocessor includes a sensor and a microprocessor. The sensor has a first end and a second end. The first end radiates a beam of light which is registered at the second end. The counter wheel has a plurality of perforations disposed circumferentially within the counter wheel. The sensor is configured to shine the beam of light through each of the plurality of perforations as the counter wheel rotates. Thusly, a frequency of pulses is sensible at the sensor second end. The frequency of the pulses corresponds to a range of motion of the track cleaning car. When the pulses of light are registered statically, or are statically absent at the sensor second end, the track cleaning car is at rest. The sensor relays a signal to the microprocessor. The microprocessor arrests the motor when the track cleaning car is not in motion, thereby disabling the rotating disk when the track cleaning car is at rest.

A second wheel assembly is disposed on the base plate bottom surface proximal to the rear end. The second wheel assembly drives the track cleaning car in a forward or rearward direction, as desired. The second wheel assembly is powered by the battery disposed on the base plate and alternately by an extant powered rail track. However, the present track cleaning car is not envisioned to be self-propelled, but rather pulled and alternately pushed by an extant engine, as desired.

A control panel is also disposed on the base plate top surface. The control panel is in operational communication with the motor, the photomicroprocessor, the battery, and the second wheel assembly. The control panel is in operational communication with the second wheel assembly and selectively controls the speed of the track cleaning car in a forward and alternately rearward direction. The control panel is also in operational communication with the motor, and the speed of the rotatable disk is controllable by means of the control panel, as desired.

In the preferred embodiment herein specified, the battery is envisioned as a rechargeable 12 volt Nimh battery. The battery is rechargeable by means of an external power source or while the track cleaning car is operated upon an extant powered rail track.

Cleaning track by hand is hard work and can take several hours. Existing prototypes of the present track cleaning car can clean 100 feet of track in approximately three to six minutes.

Thus has been broadly outlined the more important features of the present track cleaning car so that the detailed description thereof that follows may be better understood and in order that the present contribution to the art may be better appreciated.

DETAILED DESCRIPTION OF THE DRAWINGS

Figure 1:
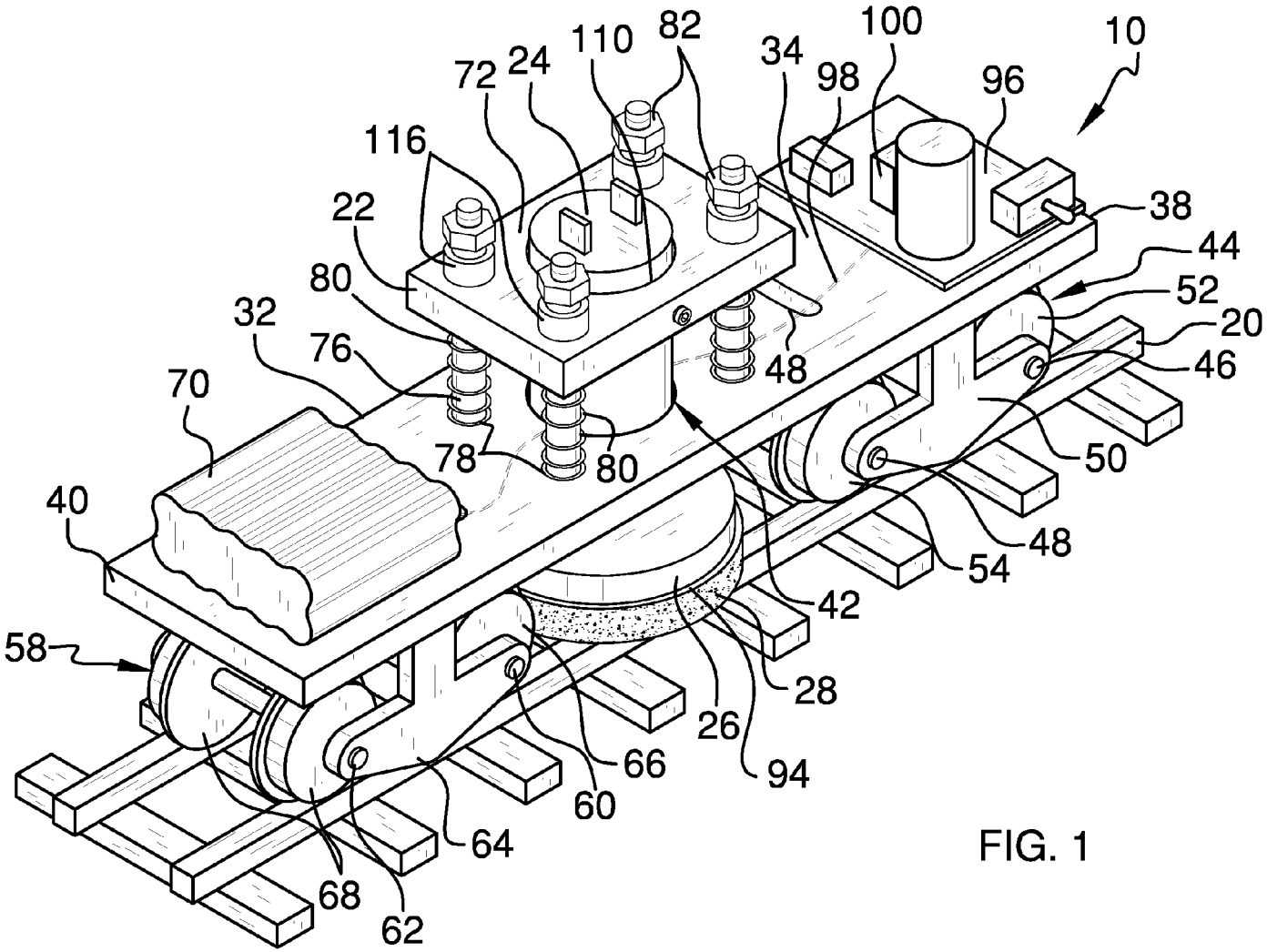
FIG. 1 is a perspective view of a track cleaning car.
Figure 2:
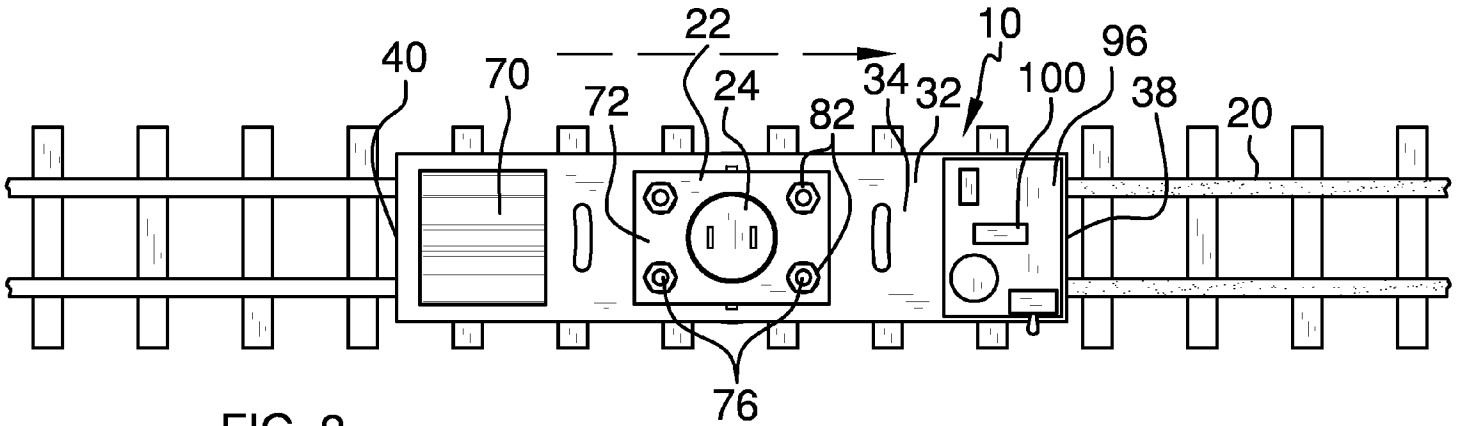
FIG. 2 is a top view of the track cleaning car.
Figure 3:
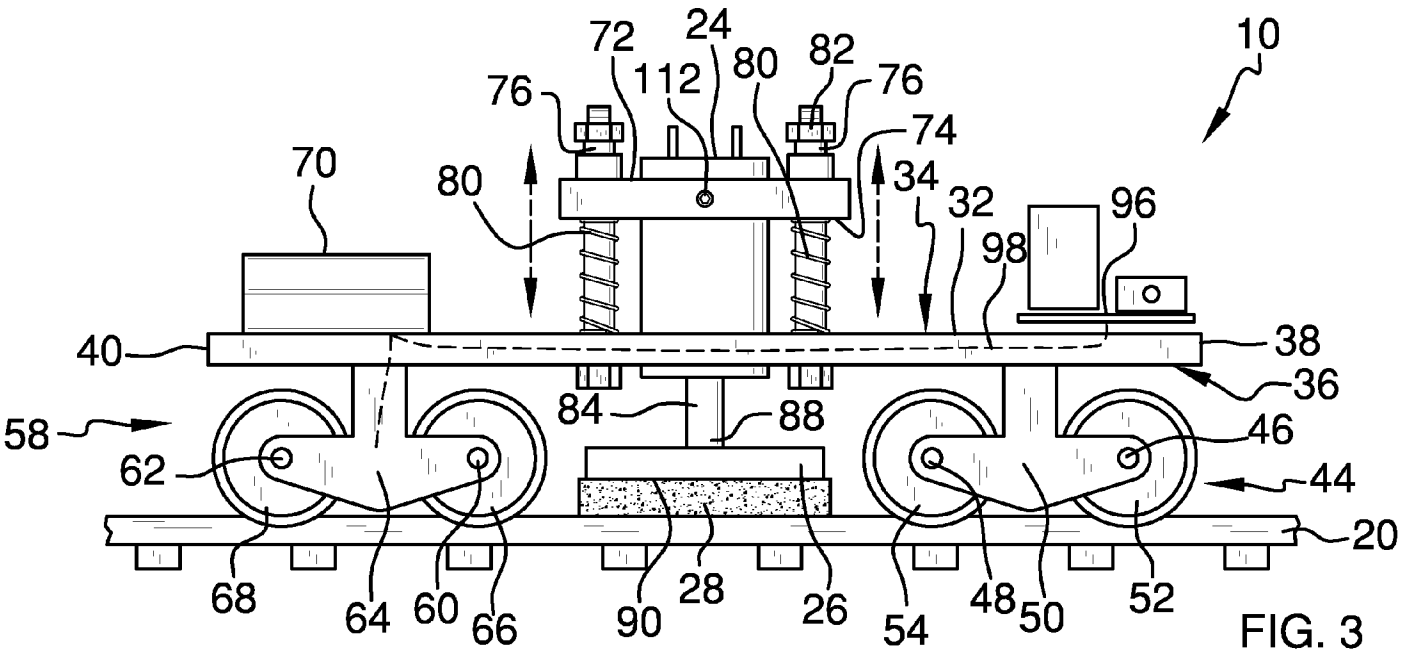
FIG. 3 is a side view of the track cleaning car.
Figure 4:
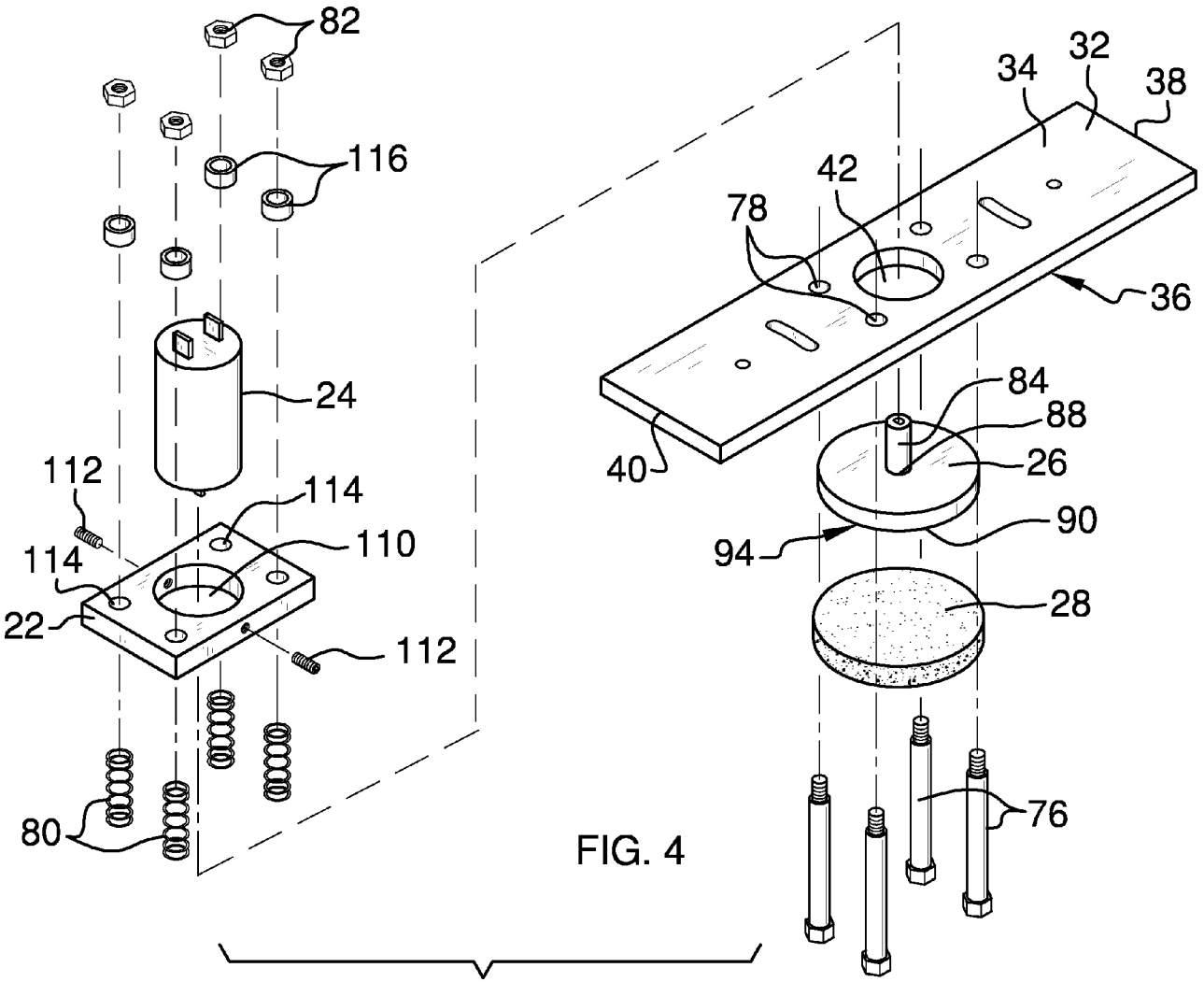
FIG. 4 is an exploded view of a motor disposed within a floating plate.
Figure 5:
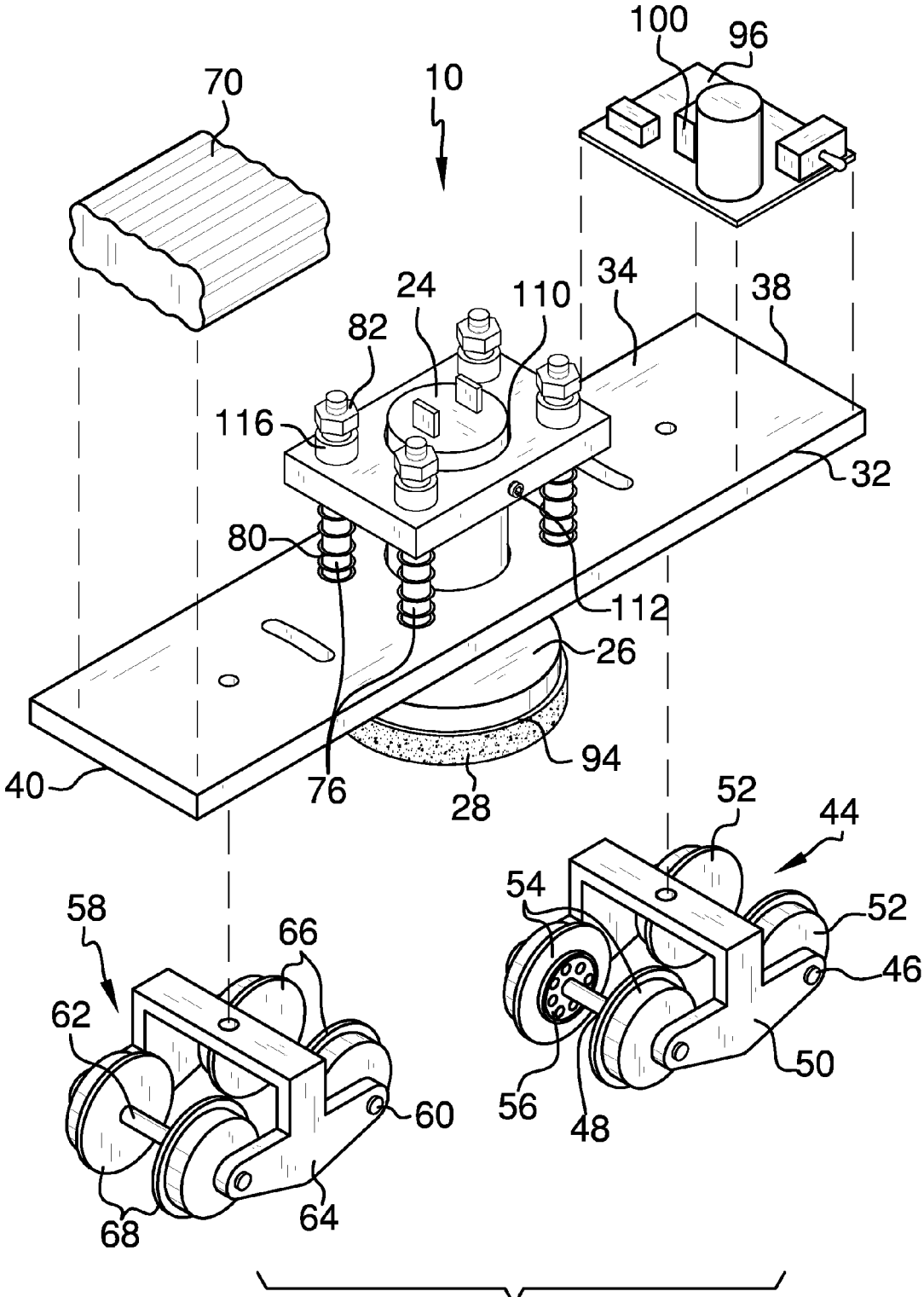
FIG. 5 is an exploded view a first wheel assembly, a second wheel assembly, a control panel, and a battery pack attachable to a base plate.
Figure 6:
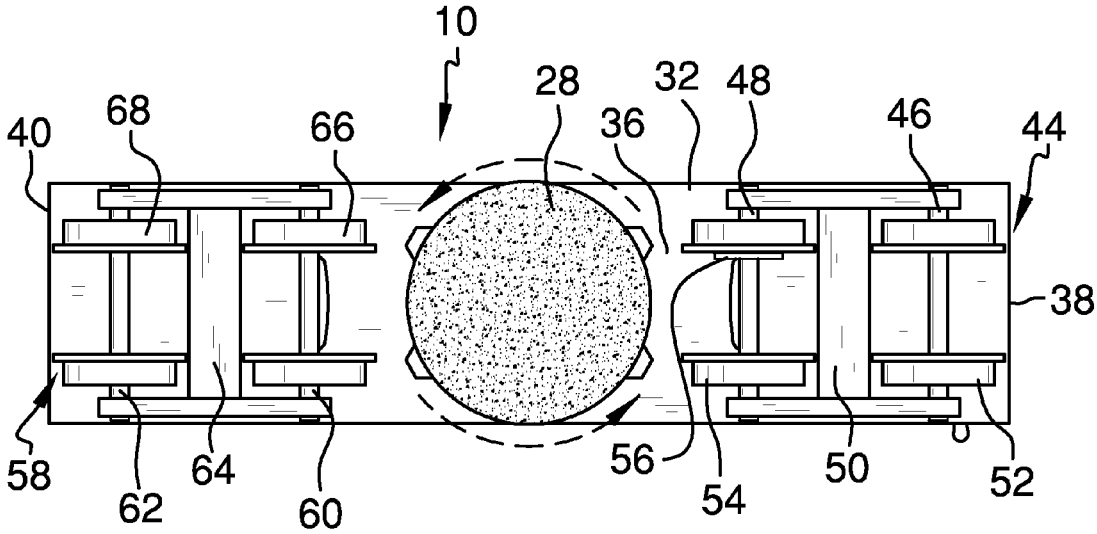
FIG. 6 is a bottom view of the track cleaning car.
Figure 7:
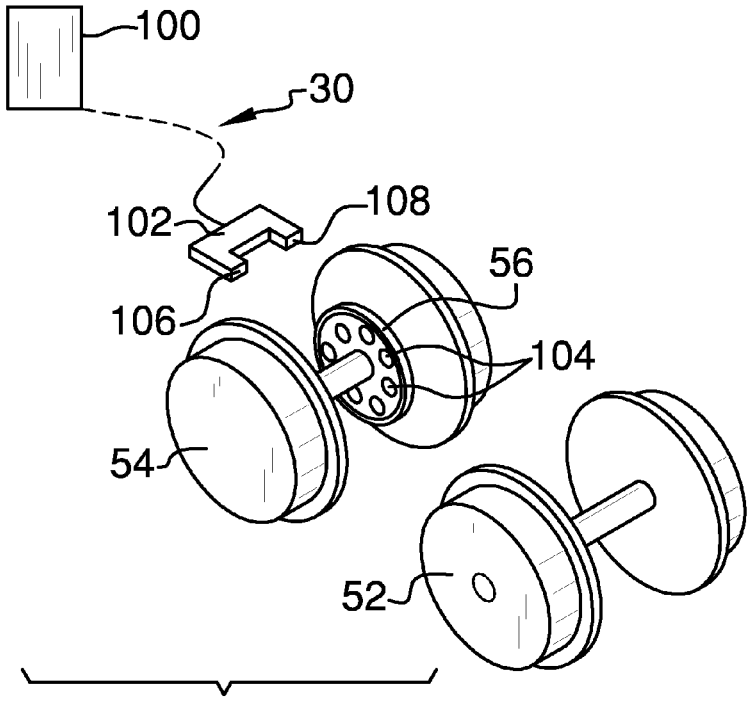
FIG. 7 is an exploded view of a photomicroprocessor.

With reference now to the drawings, and in particular FIGS. 1 through 7 thereof, an example of the instant track cleaning car employing the principles and concepts of the present track cleaning car and generally designated by the reference number 2 will be described.

Referring to FIGS. 1 through 7, a preferred embodiment of the present track cleaning car 10 is illustrated.

The present track cleaning car 10 is devised to operate on an extant rail track 20 for the purposes of cleaning said rail track 20. The present track cleaning car 10 includes a floating plate 22 with a motor 24 disposed thereon, which motor 24 operationally drives a rotatable disk 26 with a removable cleaning pad 28 configured to contact the extant rail track 20, as will be described in this detailed description. Further, a photomicroprocessor 30 is in operational communication with the motor 24, the photomicroporcessor 30 arresting the motor 24 when sensing the track cleaning rail car 10 is not in motion.

The track cleaning car 10 includes a parallelepiped base plate 32 having a top surface 34, a bottom surface 36, a front end 38, and a rear end 40. The base plate 32 has a hole 42 centrally disposed therethrough. A first wheel assembly 44 is disposed on the base plate 32 bottom surface 36 at the front end 38.

The first wheel assembly 44 includes a first axle 46 and a second axle 48 disposed in parallel, the first 46 and second 48 axles disposed rotatably within a forward truck 50. A pair of first wheels 52 is disposed endwise upon the first axle 46 and a pair of second wheels 54 is disposed endwise upon the second axle 48. A counter wheel 56 is disposed in parallel with the pair of second wheels 54. The counter wheel 56 is rotated synchronously with the pair of second wheels 54. The photomicroprocessor 30 is disposed on the forward truck 50 in operational communication with the counter wheel 56. The photomicroporcessor 30 is configured to arrest the motor 24 when sensing the counter wheel 56 is not turning, as will be described subsequently.

A second wheel assembly 58 is disposed on the base plate 32 bottom surface 36 at the rear end 40. The second wheel assembly 58 includes a third axle 60 and a fourth axle 62 likewise disposed in parallel, the third 60 and fourth 62 axles disposed rotatably within a rearward truck 64. A pair of third wheels 66 is disposed endwise on the third axle 60 and a pair of fourth wheels 68 is disposed endwise on the fourth axle 62. The second wheel assembly 58 is operationally engaged by means of a battery 70 and alternately and concurrently by means of an extant powered rail track, as will be described subsequently, to operationally drive the track cleaning car 10 in a forward and alternately rearward direction.

The floating plate 22 is disposed above the base plate 32 top surface 34, the floating plate 22 disposed in a plane parallel with the base plate 32 top surface 34. The floating plate 22 has a top side 72 and a bottom side 74. The floating plate 22 is supported above the base plate 32 by means of a plurality of guide rods 76. A plurality of guide holes 78 is disposed in the base plate 32 and each of the plurality of guide rods 76 is vertically disposed through each of the plurality of guide holes 78. Each of a plurality of springs 80 is disposed around each of the plurality of guide rods 76 between the floating plate 22 and the base plate 32, said springs 80 compressibly engaging the floating plate 22 above the base plate 32.

A plurality of nuts 82 is included. Each of the plurality of nuts 82 is releasably adjustably disposed atop each of the plurality of guide rods 76 engaging with the floating plate 22 top side 72, each of the plurality of guide rods 76 extended through the floating plate 22 through each of a plurality of attachment holes 114. Each of the plurality of nuts 82 adjustably secures the floating plate 22 upon the plurality of guide rods 76 at a desired height above the base plate 32. Each of the plurality of nuts 82 rests atop each of a plurality of washers 116.

The motor 24 depends from within a central aperture 110 disposed within the floating plate 22, the motor 24 centrally disposed upon the base plate 32. The motor 24 is adjustably secureable within the floating plate 22 by means of a pair of setting screws 112. The motor 24 projects a rotatable driveshaft 84 through the hole 42. The rotatable disk 26 is disposed on a lower end 88 of the driveshaft 84, the rotatable disk 26 having a lower surface 90 disposed in a plane parallel with the base plate 32. The cleaning pad 28 is removably attachable to the rotatable disk 26 lower surface 90. The cleaning pad 28 is releasably fastened to the rotating disk 26 under surface 90 by means of a hook and loop fastener 94. The cleaning pad 28 is devised to be interchangeable, allowing for replacement pads, as needed, as well as for interchanging cleaning pads of different cleaning gauges, as desirable, when operating the track cleaning car 10 to clean or polish a track under a variety of conditions requiring cleaning or polishing.

The floating plate 22 compressibly engages the cleaning pad 28 with the rail track 20 over which the cleaning car operates and the plurality of springs 80 limit the pressure of the cleaning pad 28 upon the extant rail track 20 over which the cleaning car 10 operates, while engaging the cleaning pad 28 in contact with the track 20.

The battery 70 is disposed on the base plate 32 top surface 34, the battery 70 rechargeable when the track cleaning car 10 is in operation upon an extant powered rail track 20 and alternately by means of an external power source (not shown). Thusly, as the track cleaning car 10 operates, the battery 70 may be recharged when the track cleaning car 10 is operated upon an extant powered rail track 20.

A control panel 96 is disposed on the base plate 32 top surface 34, the control panel 96 in operational communication with the motor 24, the battery 70, the photomicroprocessor 30, and the second wheel assembly 58. A plurality of wiring 98 interconnects the motor 24, the control panel 96, the battery 70, the photomicroprocessor 30, and the second wheel assembly 58. The control panel 96 is in operational communication with the motor 24 and the rotatable disk 26 is operational at different speeds selectable by means of the control panel 96. The control panel 96 is in operational communication with the second wheel assembly 58, and the track cleaning car 10 is operable at different speeds selectable by the control panel 96. The track cleaning car 10 is operable in a forward direction and alternately a rearward direction, as desired.

The photomicroprocessor 30 is in operational communication with the motor 24; the photomicroprocessor 30 arresting the driveshaft 26 when the photomicroprocessor 30 senses the counter wheel 56 is not turning. This ensures the rotatable disk 26 is not spinning when the track cleaning car 10 is not in motion in a forward or rearward direction, and lessens potential damage and wear to the track 20 upon which the track cleaning car 10 is operated.

The photomicroprocessor 30 includes a microprocessor 100 in operational communication with the motor 24 and a sensor 102 in operational communication with the counter wheel 56. The counter wheel 56 includes a plurality of perforations 104 disposed circumferentially within the counter wheel 56. The sensor 102 detects a beam of light (not shown) radiated from a first end 106 of the sensor 102 at a second end 108 of the sensor 102. The beam of light is configured to shine through each of the plurality of perforations 104. When the counter wheel 56 rotates, this beam of light is interrupted—the beam of light configured to shine alternately through each of the plurality of perforations 104 and alternately against the counter wheel 56 as the counter wheel 56 rotates. When the beam of light is constantly registered on the sensor 102 second end 108 and alternately constantly unregistered at the sensor 102 second end 108 a signal is sent from the microprocessor 100 to arrest the motor 24. The driveshaft 84 is thereby arrested, and the cleaning pad 28 is also arrested. When the light beam is registered as a frequency of pulses, the photomicroprocessor 30 enables the motor 24 to engage the rotatable disk 26. Thusly, the cleaning pad 28 is only rotated upon the track 20 when the track cleaning car 10 is in forward or rearward motion, as selected by the control panel 96.

What is claimed is:

1. A track cleaning car comprising:

a parallelepiped base plate comprising a top surface and a bottom surface, a front end and a rear end, the base plate having a hole centrally disposed therethrough;

a first wheel assembly disposed on the base plate bottom surface at the front end, the first wheel assembly comprising:

a first axle and a second axle disposed in parallel, the first and second axles disposed rotatably within a forward truck;

a pair of first wheels disposed endwise upon the first axle;

a pair of second wheels disposed endwise upon the second axle;

a counter wheel disposed in parallel with the pair of second wheels;

a photomicroprocessor disposed on the forward truck in operational communication with the counter wheel;

a second wheel assembly disposed on the base plate bottom surface at the rear end, the second wheel assembly comprising:

a second axle and a third axle disposed in parallel, the second and third axles disposed rotatably within a rearward truck;

a pair of third wheels disposed endwise on the third axle;

a pair of fourth wheels disposed endwise on the fourth axle;

a floating plate disposed above the base plate top surface, the floating plate supported above the base plate by means of a plurality of guide rods;

a motor depending from the floating plate, the motor centrally disposed upon the base plate, the motor projecting a driveshaft through the hole;

a rotatable disk disposed on the driveshaft, the rotatable disk having a lower surface disposed in a plane parallel with the base plate;

a cleaning pad removably attachable to the rotatable disk lower surface;

a plurality of springs, each of the plurality of springs compressibly engaging the floating plate above the base plate;

a battery pack disposed on the base plate top surface;

a control panel disposed on the base plate top surface;

wherein the floating plate compressibly engages the cleaning pad against an extant rail track, the second wheel assembly is driven by the battery pack and alternately an extant powered rail track, the photomicroprocessor is in operational communication with the motor, and the motor rotatably engages the driveshaft only when the cleaning car is in motion.

2. The track cleaning car of claim 1 wherein the photomicroprocessor further comprises:

a sensor comprising:

a first end;

a second end;

a microprocessor;

wherein a beam of light radiated from the first end is registered at the second end and a signal is communicated to the microporcessor.

3. The track cleaning car of claim 2 wherein the counter wheel further comprises:

a plurality of perforations circumferentially disposed within the counter wheel, each of the plurality of perforations configured to enable the beam of light to pass through the counter wheel as the counter wheel rotates, wherein pulses of light are registered on the sensor second end and the motion of the track cleaning car is communicated to the microprocessor.

4. The track cleaning car of claim 2 wherein the photomicroprocessor arrests the motor when sensing the track cleaning car is not in motion.

5. The track cleaning car of claim 4 wherein each of the plurality of springs is disposed around each of the plurality of guide rods between the floating plate and the base plate whereby the cleaning pad is compressibly engaged with the rail track over which the cleaning car operates.

6. The track cleaning car of claim 5 wherein the control panel is in operational communication with the motor whereby the rotatable driveshaft is operational at different speeds.

7. The track cleaning car of claim 6 wherein a plurality of wiring interconnects the motor, the control panel, the battery, the photomicroprocessor, and the second wheel assembly.

8. The track cleaning car of claim 7 wherein the control panel is in operational communication with the second wheel assembly to engage the second wheel assembly in a forward and alternately a backward direction.

9. The track cleaning car of claim 8 wherein the battery pack comprises a rechargeable battery, the battery rechargeable upon an extant powered rail track and alternately by means of an external power source.

10. The track cleaning car of claim 9 wherein the battery is a Nimh battery.

11. The base plate of claim 1 further comprising a plurality of guide holes, wherein each of the plurality of guide rods is disposed through each of the plurality of guide holes and the floating plate is compressibly mounted on the plurality of springs.

12. The track cleaning car of claim 11 wherein the cleaning pad is releasably fastenable to the rotating disk under surface by means of a hook and loop fastener.

13. The track cleaning car of claim 12 further comprising a plurality of nuts, each of the plurality of nuts releasably secureable upon each of the plurality of guide rods wherein the floating plate is adjustably secureable at a desired height above the base plate.

14. The track cleaning car of claim 13 wherein the second wheel assembly drives the cleaning car alternately in a forward direction and backward direction.

15. The track cleaning car of claim 14 wherein the control panel is in operational communication with the second wheel assembly to alternately increase and decrease the speed of the track cleaning car.

16. The track cleaning car of claim 15 wherein the battery is a 12 volt battery.

17. The track cleaning car of claim 16 wherein the motor is powered by the battery and alternately an extant powered rail track.

18. A track cleaning car comprising:

a parallelepiped base plate comprising a top surface and a bottom surface, a front end and a rear end, the base plate having a hole centrally disposed therethrough;

a first wheel assembly disposed on the base plate bottom surface at the front end, the first wheel assembly comprising:

a first axle and a second axle disposed in parallel, the first and second axles disposed rotatably within a forward truck;

a pair of first wheels disposed endwise upon the first axle;

a pair of second wheels disposed endwise upon the second axle;

a counter wheel disposed in parallel with the pair of second wheels, the counter wheel comprising:

a plurality of perforations circumferentially disposed within the counter wheel;

a second wheel assembly disposed on the base plate bottom surface at the rear end, the second wheel assembly comprising:

a second axle and a third axle disposed in parallel, the second and third axles disposed rotatably within a rearward truck;

a pair of third wheels disposed endwise on the third axle;

a pair of fourth wheels disposed endwise on the fourth axle;

a floating plate disposed above the base plate top surface, the floating plate supported above the base plate by means of a plurality of guide rods;

a plurality of guide holes, each of the plurality of guide rods vertically disposed through each of the plurality of guide holes;

a plurality of springs, each of the plurality of springs disposed around each of the plurality of guide rods between the floating plate and the base plate, said plurality of springs compressibly engaging the floating plate above the base plate;

a plurality of nuts, each of the plurality of nuts releasably adjustably disposed atop each of the plurality of guide rods;

a central aperture disposed within the floating plate;

a motor depending from the central aperture of the floating plate, the motor centrally disposed upon the base plate, the motor projecting a driveshaft through the hole;

a pair of setting screws releasably adjustably engaging the motor within the central aperture;

a rotatable disk disposed on the driveshaft, the rotatable disk having a lower surface disposed in a plane parallel with the base plate;

a cleaning pad removably attachable to the rotatable disk lower surface;

a rechargeable battery pack disposed on the base plate top surface, the battery pack rechargeable when the cleaning car is in operation upon an extant powered rail track and alternately by means of an external power source;

a photomicroprocessor disposed on the forward truck in operational communication with the motor, the photomicroprocessor comprising:

a sensor having a first end and a second end;

a microprocessor;

a control panel disposed on the base plate top surface, the control panel in operational communication with the motor, the battery, the photomicroprocessor, and the second wheel assembly;

a plurality of wiring interconnecting the motor, the control panel, the battery, the photomicroprocessor, and the second wheel assembly;

wherein a beam of light radiated from the sensor first end is registered at the sensor second end, the sensor configured to shine the beam of light through each of the plurality of perorations in the counter wheel, whereby a frequency of pulsed light is registered and communicated to the microprocessor;

wherein the floating plate compressibly engages the cleaning pad against an extant rail track, the second wheel assembly is driven by the battery pack and alternately an extant powered rail track, and;

the photomicroprocessor is in operational communication with the motor, the motor rotatably engaging the driveshaft only when the cleaning car is in motion.

* * * * *